US006978606B2

(12) United States Patent
Loveless, II et al.

(10) Patent No.: US 6,978,606 B2
(45) Date of Patent: Dec. 27, 2005

(54) EQUAL LENGTH CROSSOVER PIPE EXHAUST SYSTEM

(75) Inventors: Benjamin W Loveless, II, Bloomfield Hills, MI (US); William M Kehrer, Macomb, MI (US); Gregory W Nilsson, Cummings, GA (US); Bradley R Smith, Brighton, MI (US)

(73) Assignees: General Motors Corporation, Detroit, MI (US); Scambia Industrial Development AG, Schaan (LI)

( * ) Notice: Subject to any disclaimer, the term of this patent is extended or adjusted under 35 U.S.C. 154(b) by 0 days.

(21) Appl. No.: 10/286,077

(22) Filed: Nov. 1, 2002

(65) Prior Publication Data

US 2004/0083725 A1 May 6, 2004

(51) Int. Cl.[7] ..... F01N 7/10

(52) U.S. Cl. ..... 60/323; 60/313; 60/324; 180/309

(58) Field of Search ..... 60/323, 322, 313, 60/302, 320, 321, 324; 180/296, 309; 440/89 R

(56) References Cited

U.S. PATENT DOCUMENTS 4,835,965 A * 6/1989 Poehlman ..... 60/313
5,152,138 A * 10/1992 Tanabe et al. ..... 60/313
5,239,826 A * 8/1993 Hirota et al. ..... 60/302
5,331,810 A * 7/1994 Ingermann et al. ..... 60/322
5,398,504 A * 3/1995 Hirota et al. ..... 60/302
5,438,830 A * 8/1995 Matsumura ..... 60/302
5,511,505 A * 4/1996 Kobayashi et al. ..... 114/55.5
5,562,509 A * 10/1996 Nakase et al. ..... 440/89 R
6,182,447 B1 * 2/2001 Hashimura et al. ..... 60/323
6,374,600 B2 * 4/2002 Uegane et al. ..... 60/323
6,644,024 B1 * 11/2003 Powers et al. ..... 60/320

OTHER PUBLICATIONS

Photograph of the Acura MDX front exhaust pipe, Model Year 2001.

* cited by examiner

*Primary Examiner*—Tu M. Nguyen
(74) *Attorney, Agent, or Firm*—Laura C. Hargitt

(57) ABSTRACT

An equal length crossover pipe exhaust system for an engine of a vehicle includes a plurality of exhaust manifolds for connection to outlets of cylinders of the engine. The equal length crossover pipe exhaust system also includes a plurality of crossover pipes having one end connected to the exhaust manifolds and extending above the engine. The equal length crossover pipe exhaust system further includes a main takedown pipe connected to another end of the crossover pipes at an equidistant point above the engine to provide an equal length junction point between the crossover pipes.

13 Claims, 3 Drawing Sheets

EQUAL LENGTH CROSSOVER PIPE EXHAUST SYSTEM

TECHNICAL FIELD

The present invention relates generally to exhaust systems for vehicles and, more particularly, to an equal length crossover pipe exhaust system for a vehicle.

BACKGROUND OF THE INVENTION

It is known to provide an engine such as an internal combustion engine for a vehicle. It is also known to provide an exhaust system for the engine. In a vehicle such as a motor vehicle, the exhaust system typically includes exhaust manifolds connected to the engine to direct exhaust gases from the engine, exhaust pipes connected to the exhaust manifolds, a catalytic converter connected to the exhaust pipes, and an exhaust pipe connected to the catalytic converter.

Some vehicle manufacturers have manufactured vehicles with V6 cylinder banks for the internal combustion engine having a front exhaust pipe featuring equal lengths of exhaust pipe from outlets of the exhaust manifolds to a common junction point. This allows exhaust pulses from each cylinder bank of the engine to cancel each other out. In this configuration, the exhaust pipes are routed underneath the engine and/or transmission. However, in some vehicles, drivetrain packaging constraints do not allow the exhaust pipes to be routed underneath the engine and/or transmission.

Therefore, it is desirable to provide crossover pipes for an exhaust system of a vehicle that are routed above the engine and/or transmission. It is also desirable to provide equal length crossover pipes, for an exhaust system of a vehicle to allow exhaust pulses to cancel each other out to reduce perceived engine noise. It is further desirable to provide an exhaust manifold-to-manifold crossover pipe with an equal length junction point for an exhaust system of a vehicle. Thus, there is a need in the art to provide an equal length crossover pipe exhaust system that meets these desires.

SUMMARY OF THE INVENTION

It is, therefore, one object of the present invention to provide a new equal length crossover pipe exhaust system.

It is another object of the present invention to provide an equal length crossover pipe exhaust system that is routed above an engine and/or transmission of a vehicle.

To achieve the foregoing objects, the present invention is an equal length crossover pipe exhaust system for a vehicle. The equal length crossover pipe exhaust system includes a plurality of exhaust manifolds for connection to outlets of cylinders of the engine. The equal length crossover pipe exhaust system also includes a plurality of crossover pipes having one end connected to the exhaust manifolds and extending above the engine. The equal length crossover pipe exhaust system further includes a main takedown pipe connected to another end of the crossover pipes at an equidistant point above the engine to provide an equal length junction point between the crossover pipes.

One advantage of the present invention is that a new equal length crossover pipe exhaust system is provided for a vehicle that is routed above an engine and/or transmission of the vehicle. Another advantage of the present invention is that the equal length crossover pipe exhaust system greatly reduces engine firing order noise, perceived by occupants of the vehicle as a smoother, quieter engine. Yet another advantage of the present invention is that the equal length crossover pipe exhaust system facilitates a less restrictive muffler for potentially greater engine power. Still another advantage of the present invention is that the equal length crossover pipe exhaust system provides an exhaust manifold-to-manifold crossover pipe having a main takedown pipe at an equidistant point between the cylinder heads above the engine (as opposed to below the engine) to provide an "equal length" junction point.

Other objects, features, and advantages of the present invention will be readily appreciated, as the same becomes better understood, after reading the subsequent description taken in conjunction with the accompanying drawings.

DESCRIPTION OF THE PREFERRED EMBODIMENT

Figure 1:
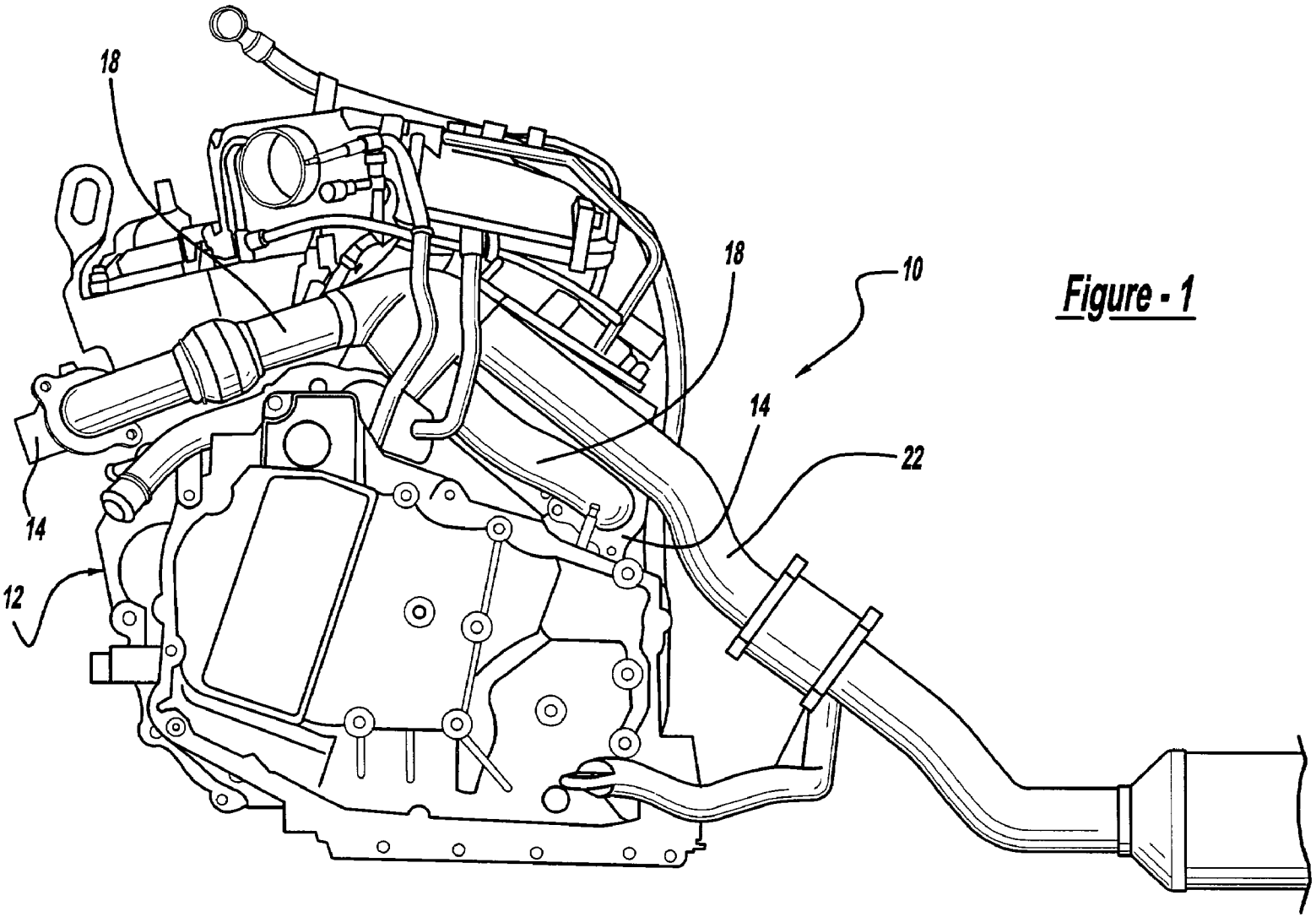
FIG. 1 is a front elevational view of an equal length crossover pipe exhaust system, according to the present invention, illustrated in operational relationship with an engine of a vehicle.

Referring to the drawings and in particular FIG. 1, one embodiment of an equal length crossover pipe exhaust system 10, according to the present invention, is shown for an engine, generally indicated at 12, such as an internal combustion engine for a vehicle (not shown) such as a motor vehicle. Preferably, the engine 12 is of a V6 type having a plurality of cylinders (not shown) grouped together in a pair of cylinder banks (not shown). It should be appreciated that, except for the equal length crossover pipe exhaust system 10, the engine 12 is conventional and known in the art.

Figure 2:
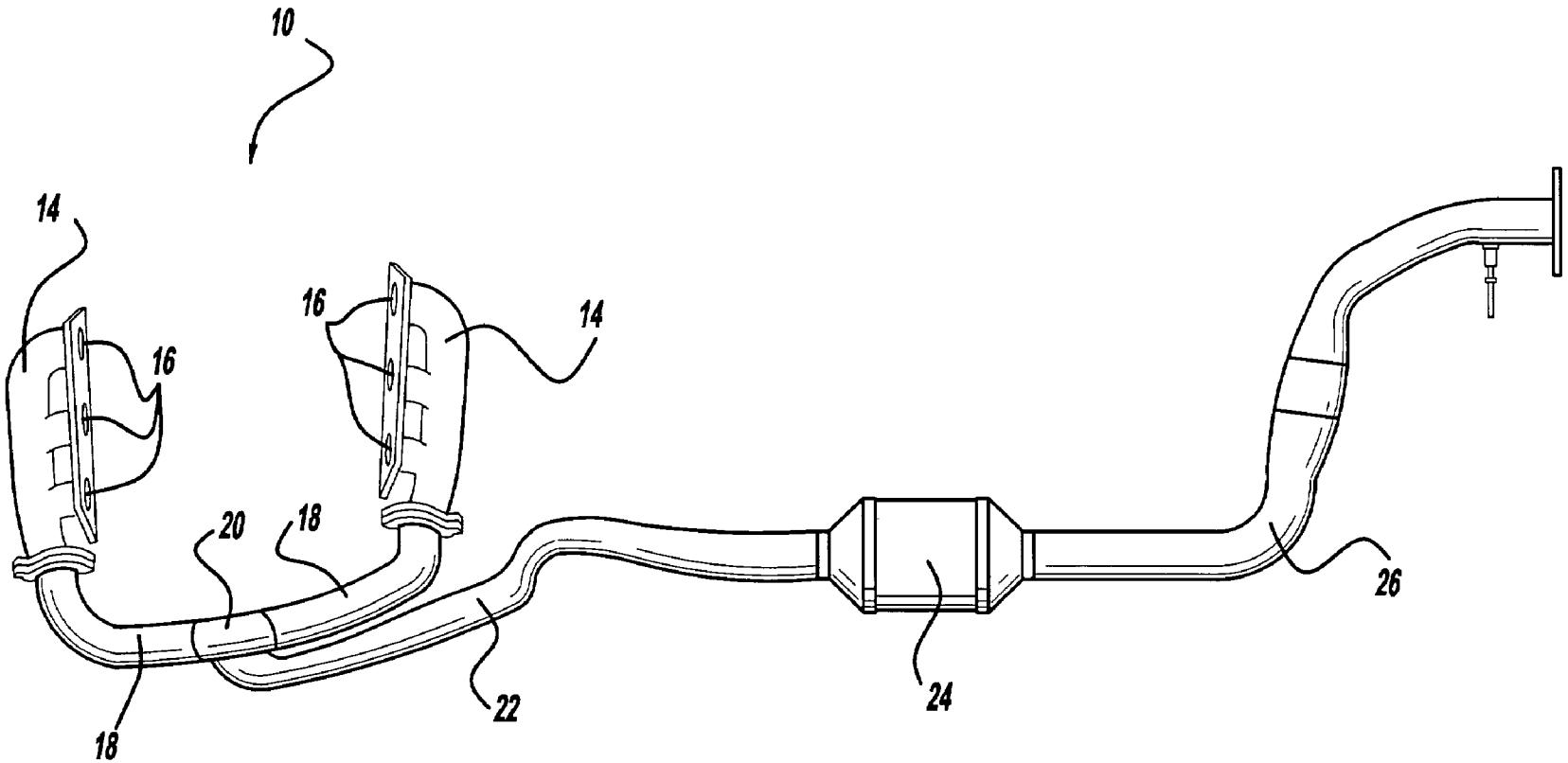
FIG. 2 is a plan view of the equal length crossover pipe exhaust system of FIG. 1.
Figure 3:
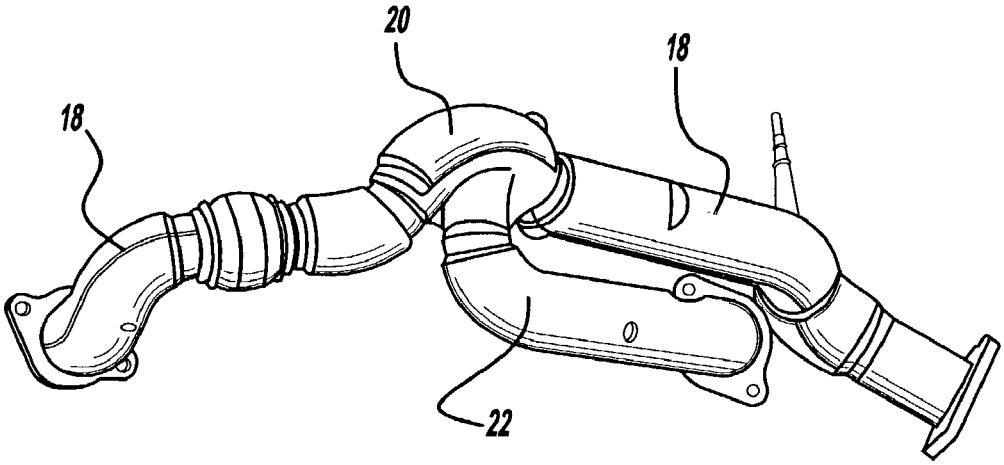
FIG. 3 is a side elevational view of a portion of the equal length crossover pipe exhaust system of FIG. 1.
Figure 4:
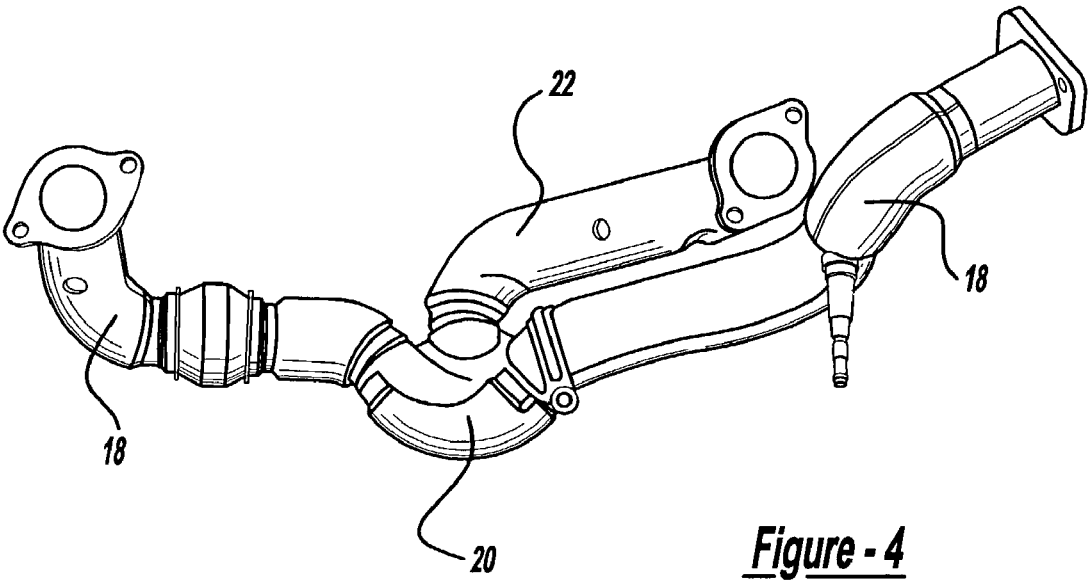
FIG. 4 is a side elevational view of another portion of the equal length crossover pipe exhaust system of FIG. 1.

Referring to FIGS. 1 and 2, the equal length crossover pipe exhaust system 10, according to the present invention, includes a plurality of, preferably a pair of exhaust manifolds 14 to direct exhaust gases from the engine 12. The exhaust manifolds 14 are tubular in shape and made of a metal material. Preferably, the exhaust manifolds 14 have an inlet 16 for each cylinder of the engine 12. The inlets 16 of the exhaust manifolds 14 are connected to outlets of the cylinders for the cylinder banks of the engine 12 by suitable means such as fasteners (not shown). It should be appreciated that the exhaust manifolds 14 are conventional and known in the art.

The equal length crossover pipe exhaust system 10 also includes exhaust crossover pipes 18 routed over or extending above the engine 12 between the exhaust manifolds 14. The exhaust crossover pipes 18 are generally tubular in shape and made of a metal material. The exhaust crossover pipes 18 are of a substantially equal axial length, that is less than fifty centimeters (50 cm) difference in axial length between the exhaust crossover pipes 18. Preferably, the exhaust crossover pipes 18 have less than ten centimeters (10 cm) difference in axial length. The exhaust crossover pipes 18 have one end connected to the exhaust manifolds 14 by suitable means such as fasteners (not shown). The exhaust crossover pipes 18 have their other end connected at 20 to a main takedown or intake pipe 22.

The equal length crossover pipe exhaust system 10 includes a main takedown or intake pipe 22 at an equidistant point between the cylinder banks above the engine 12 (as opposed to below the engine 12) to provide an "equal length" junction point 20. The main takedown pipe 22 is generally tubular and made of a metal material. The end of the main takedown pipe 22 is connected to the exhaust crossover pipes 18 by suitable means such as welding. It should be appreciated that the exhaust crossover pipes 18 and main takedown pipe 22 may be a monolithic structure being integral, unitary, and one-piece.

The equal length crossover pipe exhaust system 10 further includes a catalytic converter 24 connected to the other end of the main takedown pipe 22. The equal length crossover pipe exhaust system 10 includes an exhaust outlet pipe 26, which may have a muffler (not shown), connected to the other end of the catalytic converter 24. It should be appreciated that exhaust gases from the engine 12 flow through the exhaust manifolds 14, exhaust crossover pipes 18, main takedown pipe 22, catalytic converter 24, and exhaust outlet pipe 26 to atmosphere. It should be appreciated that the catalytic converter 24 and exhaust outlet pipe 26 are conventional and known in the art.

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. An equal length crossover pipe exhaust system for an engine of a vehicle comprising:

a plurality of exhaust manifolds for connection to outlets of cylinders of the engine;

a plurality of crossover pipes having one end directly connected to said exhaust manifolds and extending directly above the engine between said exhaust manifolds;

a main takedown pipe having one end connected to another end of each of said crossover pipes at an equidistant point directly above and adjacent to the engine to provide an equal length junction point between said crossover pipes; and a catalytic converter connected to another end of said main takedown pipe.

2. An equal length crossover pipe exhaust system as set forth in claim 1 wherein said crossover pipes have a difference in length of less than fifty centimeters.

3. An equal length crossover pipe exhaust system as set forth in claim 1 wherein said crossover pipes have a difference in length of less than ten centimeters.

4. An equal length crossover pipe exhaust system as set forth in claim 1 wherein said main takedown pipe is welded to said crossover pipes.

5. An equal length crossover pipe exhaust system as set forth in claim 1 wherein said main takedown pipe and said crossover pipes are formed as one-piece.

6. An equal length crossover pipe exhaust system as set forth in claim 1 including an exhaust outlet pipe connected to an outlet of said catalytic converter.

7. An exhaust system for a vehicle comprising:

a pair of exhaust manifolds for connection to a pair of cylinder banks of an engine of the vehicle;

a pair of crossover pipes having one end directly connected to said exhaust manifolds and extending directly above the engine between said exhaust manifolds;

a main takedown pipe having one end connected to another end of each of said crossover pipes at an equidistant point directly above and adjacent to the engine to provide an equal length junction point between said crossover pipes; and a catalytic converter connected to another end of said main takedown pipe.

8. An exhaust system as set forth in claim 7 wherein said crossover pipes have a difference in length of less than fifty centimeters.

9. An exhaust system as set forth in claim 7 wherein said crossover pipes have a difference in length of less than ten centimeters.

10. An exhaust system as set forth in claim 7 wherein said main takedown pipe is welded to said crossover pipes.

11. An exhaust system as set forth in claim 7 wherein said main takedown pipe and said crossover pipes are formed as one-piece.

12. An exhaust system as set forth in claim 7 including an exhaust outlet pipe connected to an outlet of said catalytic converter.

13. A motor vehicle comprising:

an engine of a V-type having a pair of cylinder banks;

a pair of exhaust manifolds connected to said cylinder banks;

a pair of crossover pipes having one end directly connected to said exhaust manifolds and extending directly over said engine between said exhaust manifolds;

a main takedown pipe having one end connected to another end of each of said crossover pipes at an equidistant point directly over and adjacent to said engine to provide an equal length junction point between said crossover pipes, said crossover pipes having a difference in length of less than fifty centimeters; and a catalytic converter connected to another end of said main takedown pipe.

* * * * *